US005597098A

United States Patent [19]

Pandolfi et al.

[11] Patent Number: 5,597,098

[45] Date of Patent: Jan. 28, 1997

[54] MACHINE FOR TURNING STOCKINGS THE RIGHT WAY OUT, WITH HIGH OPERATING RELIABILITY

[75] Inventors: Renato Pandolfi, Gorle; Mario Valle, Pavia, both of Italy

[73] Assignee: Conti Complett S.p.A., Milan, Italy

[21] Appl. No.: 642,739

[22] Filed: May 3, 1996

[30] Foreign Application Priority Data

May 23, 1995 [IT] Italy ..... MI95A1055

[51] Int. Cl.[6] ..... A41H 43/00

[52] U.S. Cl. ..... 223/39; 223/41; 223/42

[58] Field of Search ..... 223/39, 40, 41, 223/42

[56] References Cited

U.S. PATENT DOCUMENTS

| | | | |
|---|---|---|---|
| 4,516,703 | 5/1985 | Orosei | 223/39 |
| 4,627,557 | 12/1986 | Canton | 223/39 |
| 5,392,970 | 2/1995 | Orosei | 223/39 |

*Primary Examiner*—Bibhu Mohanty
*Attorney, Agent, or Firm*—Guido Modiano; Albert Josif

[57] ABSTRACT

Machine for turning stockings the right way out which has a first pair of rollers that have mutually parallel axes, are arranged laterally on opposite sides with respect to a median plane, and are rotatable about their respective axes with mutually opposite rotational directions. A gripper is provided for positioning a stocking to be turned the right way out between the first pair of rollers and a mechanism moves the rollers mutually closer or further apart to retain, between the rollers, the stocking carried by the gripper. Variable-speed motors turn the rollers about their respective axes and with mutually opposite rotational directions. A rod is inserted on command between the rollers and cooperates with the rollers to turn the stocking the right way out along the rod. A motor-driven slider moves the rod along its own axis, which is substantially perpendicular to the axes of the rollers, for the insertion of the rod between the rollers or the extraction of the rod therefrom. The variable speed motors for turning the rollers about their respective axes are controlled by a programmable actuation and control unit which supervises the operation of the entire machine.

41 Claims, 9 Drawing Sheets

61
70
27
1

III
8
2
VI
5
36
9
II
6b
6a
7b
7a
35a
35b
3b
4b
3a
4a
VI
VII
54
44a
55
59
43
58
VII
44b
57
56
56

MACHINE FOR TURNING STOCKINGS THE RIGHT WAY OUT, WITH HIGH OPERATING RELIABILITY

BACKGROUND OF THE INVENTION

The present invention relates to a machine for turning hosiery items such as stockings the right way out, with high operating reliability.

The term "stocking" is used herein, for conciseness of description, to refer to knit close-fitting coverings for the foot and leg, such as men's socks and women's stockings, as well as hosiery items which are subsequently interconnected for manufacturing women's tights.

It is known that the production process for manufacturing stockings comprises a step for the production of a tabular hosiery component that is open at its longitudinal ends and is then closed by sewing or linking at one of said ends that constitutes the toe of the stocking.

The operation for linking or sewing the toe of the stocking is performed while the stocking is inside out, and it is therefore necessary to turn the stocking the right way out again before packaging it.

Stockings are currently turned the right way out by using machines that are essentially composed of a structure that supports one or two pairs of rollers with horizontal axes, wherein the rollers of each pair are arranged laterally on opposite sides with respect to an imaginary vertical median plane, at which the stocking is fed to the turning machine by means of an appropriate gripper that places the stocking between the lower pair of rollers so that the toe of the stocking is just above said pair of rollers.

Above the rollers there is a rod or stem that is arranged so that its axis is vertical and lies in said median plane. The rollers can move on command towards or away from each other, so as to laterally engage on opposite sides the stocking that is arranged between them; furthermore, the rollers can be rotated about their respective axes, whereas the rod can move along its own axis so that it lies between the rollers of a same pair.

Said rollers are actuated for rotation about their respective axes by means of one or more constant-speed electric motors, whereas the mutual approach or spacing of the rollers is achieved by means of pneumatic cylinders; likewise, the movement of the rod along its own axis is also actuated by means of a pneumatic cylinder.

During the operation of these known types of machine, the gripper, while holding the linked or sewn stocking (which is inside-out) by its toe, places the stocking item between the lower rollers, which are in the mutually spaced position, so that the toe is located directly above said rollers. Then the lower rollers are moved mutually closer so as to retain the stocking between them and the gripper is disengaged from the toe of the stocking and moved away from the rollers. The lower rollers are then rotated about their respective axes in mutually opposite rotational directions, so that their peripheral speed at the region of contact with the stocking is directed upwards, i.e., towards the rod, which is actuated so as to engage the tip or toe of the stocking, which by virtue of the rotation of the lower rollers, begins to turn the right way out along the rod. The upper rollers are then moved into the mutual approach position and are rotated about their respective axes in a similar manner to the lower rollers, so that when the stocking arrives at the upper rollers while it is being turned the right way out along the rod, the stocking is also gripped by said rollers and is turned completely the right way out along the rod.

At this point, the direction of the rotation of the lower rollers is reversed; in this manner, the rollers remove the stocking and move it away from the rod, which is then returned to the starting position.

Said conventional machines for turning stockings the right way out, however, have some drawbacks.

During the operation for turning the stockings the right way out on the rod, slippage in fact occurs between the lower rollers and said stocking and can lead to damage to the stocking. Furthermore, since the mutual approach of the rollers is actuated by pneumatic cylinders, depending on the type of stocking to be turned the right way out and particularly on the thickness of the fabric of said stocking, it is necessary to perform adjustments of the pneumatic cylinders every time the type of stocking to be turned the right way out changes, and it is also necessary to manually adjust the stroke of the rod to adapt it to the length of the stocking to be turned the right way out to avoid damaging it or to allow to turn it the right way out.

The use of pneumatic actuators to actuate the various movements of the parts of the machine also requires the presence of a system for supplying compressed air as well as continuous manual adjustments of the pneumatic circuit to obviate drawbacks arising from accidental variations in operation that are typical of pneumatic components.

SUMMARY OF THE INVENTION

The aim of the present invention is to solve the above problems by providing a machine for turning stockings the right way out that is highly reliable in operation.

Within the scope of this aim, an object of the invention is to provide a machine that can turn various types of stockings the right way out according to preset programs without requiring continuous manual adjustments.

Another object of the invention is to provide a machine that effectively avoids slippage between the rollers and the stocking during the action for turning the stocking the right way out, so as to avoid damage to the stocking, even in the case of stockings that are knitted with very fine thread.

Another object of the invention is to provide a machine in which the various operating parameters can be changed to adapt the operation of the machine to various types of stockings, ensuring in any condition the maximum precision in turning such stockings inside out.

Another object of the invention is to provide a machine that can operate without requiring a compressed air supply system.

This aim, these objects, and others which will become apparent hereinafter are achieved by a machine for turning stockings the right way out, with high operating reliability, which comprises: at least one first pair of rollers that have mutually parallel axes, are arranged laterally on opposite sides with respect to an imaginary median plane that is parallel to the axes of said rollers, and can be rotated about their respective axes in mutually opposite rotational directions; means for positioning a stocking to be turned the right way out between said first pair of rollers; first means for moving said rollers mutually closer or further apart to retain, between said rollers, the stocking carried by said positioning means; first means for rotating said rollers about their respective axes in mutually opposite rotational directions; a rod controllably insertable between said rollers and cooperating with said rollers to turn the stocking the right way out along said rod; means for moving said rod along its own axis, which is arranged in said median plane and is substantially perpendicular to the axes of said rollers, for the insertion of said rod between said rollers or the extraction of said rod therefrom; characterized in that said first means for rotating said rollers about their respective axes comprise at least one first variable-speed motor.

BRIEF DESCRIPTION OF THE DRAWINGS

Further characteristics and advantages of the invention will become apparent from the description of a preferred but not exclusive embodiment of the machine according to the invention, illustrated only by way of non-limitative example in the accompanying drawings, wherein.

DESCRIPTION OF THE PREFERRED EMBODIMENTS

Figure 1:
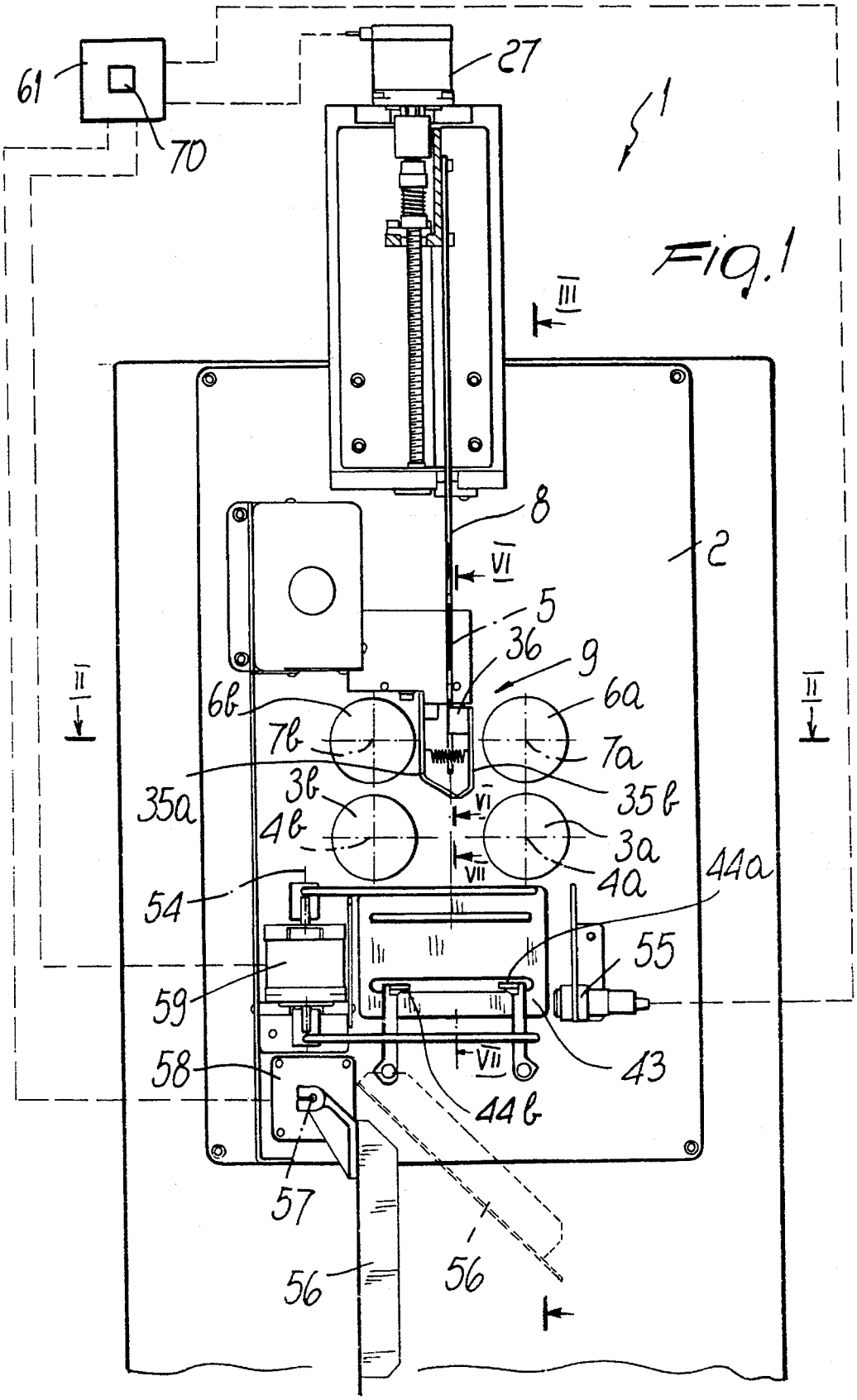
FIG. 1 is a schematic and partially sectional front elevation view of the machine according to the invention.

With reference to the above figures, the machine according to the invention, generally designated by the reference numeral 1, comprises a supporting structure 2 that supports at least one first pair of rollers 3*a* and 3*b* that have mutually parallel axes 4*a* and 4*b*, are arranged laterally on opposite sides with respect to an imaginary median plane 5, and can be rotated about their respective axes 4*a* and 4*b* with mutually opposite rotational directions.

Preferably, the rollers 3*a* and 3*b* are arranged so that their axes 4*a* and 4*b* are horizontal and the median plane 5 is vertical.

Conveniently, above the first pair of rollers 3*a* and 3*b* there is a second pair of rollers 6*a* and 6*b*; said second rollers have mutually parallel and horizontal axes 7*a* and 7*b*, are arranged laterally on opposite sides with respect to the median plane 5, and can be rotated about their respective axes 7*a* and 7*b* with mutually opposite rotational directions.

The machine is provided with first means for rotating the rollers 3*a* and 3*b* about their respective axes and with mutually opposite rotational directions and with second means for rotating the second pair of rollers 6*a* and 6*b* about their respective axes 7*a* and 7*b* and with mutually opposite rotational directions.

The machine according to the invention also comprises means 9 for positioning a stocking 60 to be turned the right way out between the rollers 3*a* and 3*b*.

The machine also comprises first means for moving the rollers 3*a* and 3*b* mutually closer or further apart, as well as second means for moving the rollers 6*a* and 6*b* mutually closer or further apart.

A rod or stem 8 is arranged at the median plane 5 and is supported above the rollers; means are provided for moving the rod 8 along its axis, which is preferably arranged vertically, i.e., at right angles to the axes 4*a* and 4*b* of the rollers 3*a* and 3*b*, to insert it between said rollers or to extract it from a position between said rollers, tangentially with respect to said mutually approached rollers.

The first means for the actuation of the rollers 3*a* and 3*b* of the first pair of rollers, according to the invention, are constituted by at least one first variable-speed motor, preferably an electric motor of the type known as a step motor or an electric motor of the brushless type.

Figure 2:
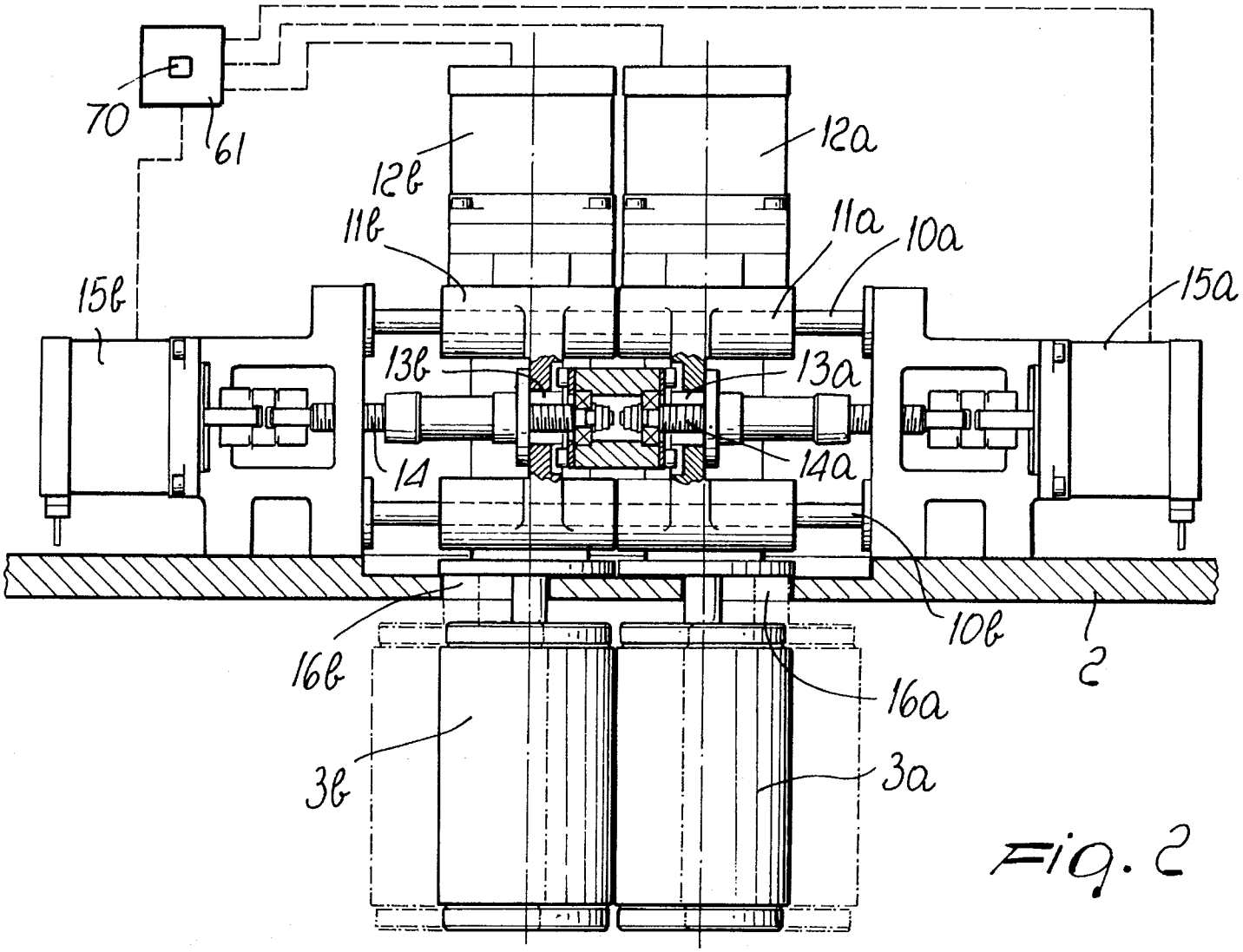
FIG. 2 is an enlarged-scale schematic sectional view of FIG. 1, taken along the plane II—II.
Figure 3:
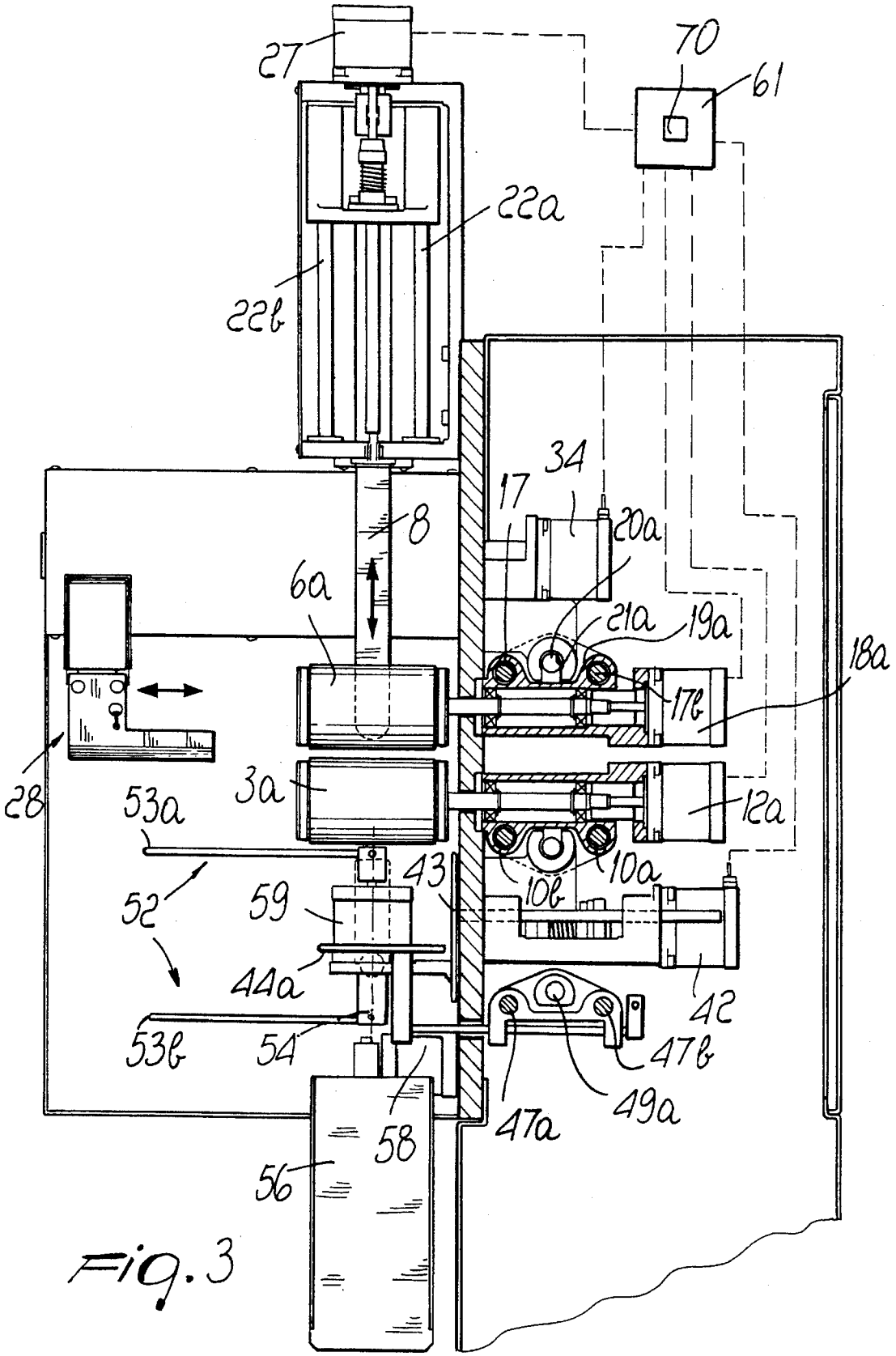
FIG. 3 is a schematic sectional view of FIG. 1, taken along the plane III—III.

As shown in particular in FIGS. 2 and 3, the means for moving the rollers 3*a* and 3*b* mutually closer or further apart comprise two guides 10*a* and 10*b* that are rigidly connected to the supporting structure 2, are arranged horizontally, and are orientated at right angles to the median plane 5. Said guides 10*a* and 10*b* support, so that they can slide along their length, a carriage 11*a* that supports the roller 3*a* so that it can rotate about the axis 4*a* and a carriage 11*b* that supports the roller 3*b* so that it can rotate about the axis 4*b*.

A variable-speed motor 12*a* is mounted on the carriage 11*a* and is connected to the roller 3*a* by means of its output shaft, whereas a motor 12*b* is mounted on the carriage 11*b* and is connected to the roller 3*b* by means of its output shaft.

The carriage 11*a* is rigidly coupled to an internal thread or female screw 13*a*, with which a screw 14*a* engages; said screw is connected to the output shaft of a motor 15*a* that is preferably constituted by a variable-speed electric motor.

In the same manner, the carriage 11*b* is rigidly coupled to an internal thread or female screw 13*b* with which a screw 14*b* engages; said screw is connected to the output shaft of a motor 15*b* that is also preferably constituted by a variable-speed electric motor.

Preferably, the motors 15*a* and 15*b* are constituted by electric step motors or brushless electric motors and are supported by the supporting structure 2 so that the actuation of the electric motors 15*a* and 15*b* causes translatory motion of the carriages 11*a* and 11*b* along the guides 10*a* and 10*b*, thus moving the rollers 3*a* and 3*b* toward or away from each other. The translatory motion of the rollers toward or away from each other is allowed by the fact that appropriately provided slots 16*a* and 16*b* are formed in the supporting structure 2 and are elongated horizontally and substantially at right angles to the axes 4*a* and 4*b* of the rollers 3*a* and 3*b*; the output shafts of the motors 12*a* and 12*b* pass through said slots.

The rollers 6*a* and 6*b* of the second pair of rollers are mounted, so that they can rotate about their respective axes, in a manner that is similar to what has been described and illustrated with reference to the first pair of rollers, on carriages that are slidingly supported on a pair of guides 17*a* and 17*b* that are fixed to the supporting structure 2 and are arranged horizontally and substantially at right angles to the axes 7*a* and 7*b*. The motion of the carriages along the guides 17*a* and 17*b* to achieve the mutual approach or spacing of the rollers 6*a* and 6*b* is achieved, similarly to what has been described and illustrated with reference to the first pair of rollers 3*a* and 3*b*, by means of variable-speed motors, constituted for example by variable-speed electric motors, preferably electric step motors or brushless electric motors. Each roller 6*a* and 6*b* is connected to the output shaft of a variable-speed motor that is constituted by an electric variable-speed motor, preferably an electric step motor or a brushless electric motor. FIG. 3 illustrates the electric motor 18*a* which turns the roller 6*a* about its own axis, the carriage 19*a* that supports said roller. As also shown in FIG. 3, the screw 20*a* engages an internal thread 21*a* that is rigidly coupled to the carriage 19*a* and is connected to the output shaft of the motor that causes the translatory motion of the carriage 19*a* along the guides 17*a* and 17*b*. The motor that turns the roller 6*b*, as well as the other elements that move the rollers 6*a* and 6*b* toward or away from each other, have been omitted in the figures for the sake of simplicity, since they substantially correspond to what has been illustrated in FIG. 2 with reference to the rollers 3*a* and 3*b*.

As an alternative, instead of using two variable-speed motors to achieve the mutual spacing or approach of the rollers 3*a* and 3*b*, as well as of the rollers 6*a* and 6*b*, it is possible to use a single variable-speed motor that is connected, by means of its output shaft, to a screw that has two threaded portions with mutually opposite directions of the thread helix that engage the internal threads that are rigidly coupled to the carriages supporting the respective rollers, so as to obtain the mutual approach or spacing of the rollers by means of the actuation of a single variable-speed motor.

Conveniently, the lateral surface of the rollers 3*a* and 3*b* and the lateral surface of the rollers 6*a* and 6*b* are coated with a layer of flexible material and may be provided with raised axial ridges.

Figure 4:
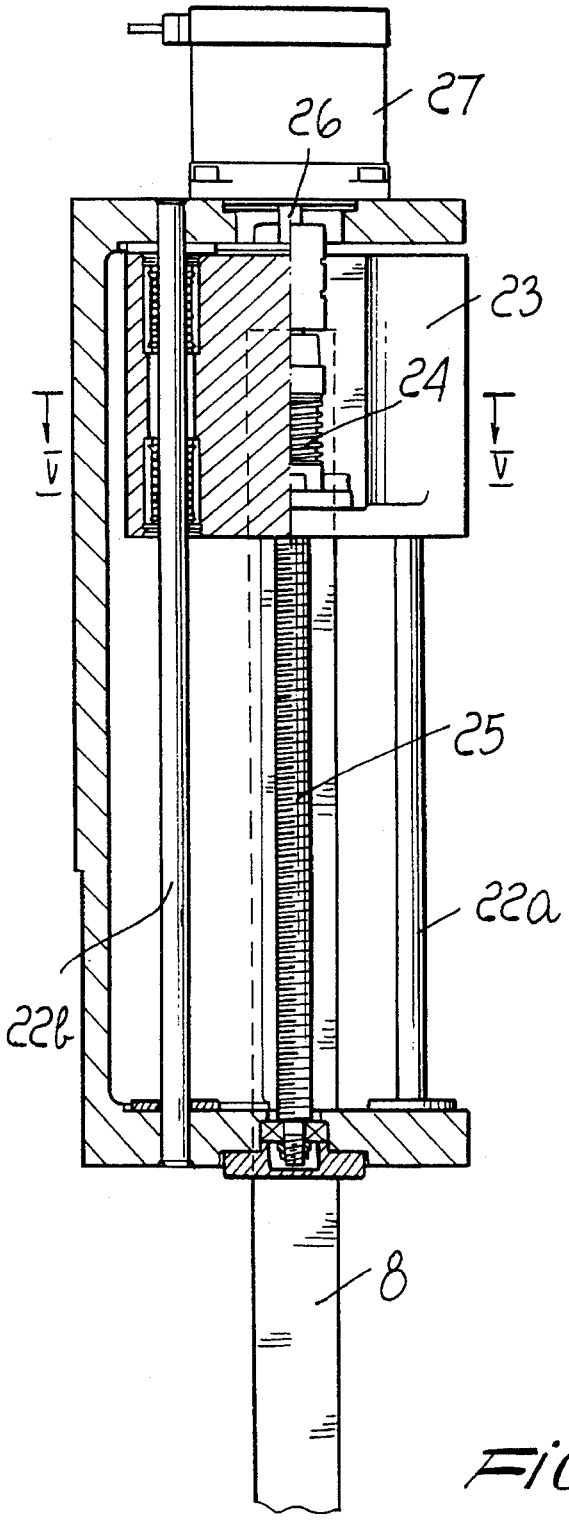
FIG. 4 is an enlarged and sectional view of a detail of FIG. 3 related to the rod actuation means.
Figure 5:
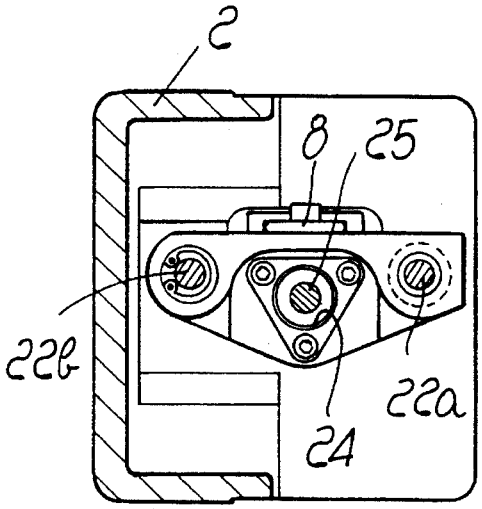
FIG. 5 is a sectional view of FIG. 4, taken along the plane V—V.

The means for moving the rod 8 along its axis comprise, as shown in particular in FIGS. 4 and 5, two vertical guides 22*a* and 22*b* that are rigidly coupled to the supporting structure 2. The guides 22*a*,22*b* slideably support a slider 23 that is rigidly coupled to an internal thread or female screw 24 with which a screw 25 couples; said screw is supported, so that it can rotate about its own axis, by said supporting structure 2 and is orientated parallel to the guides 22*a* and 22*b*. The screw 25 is connected to the output shaft 26 of a variable-speed motor 27 that is constituted by an electric motor, preferably an electric step motor or an electric brushless motor. The rod 8 is fixed, by means of its upper end, to the slider 23 so that the translatory motion of the slider 23 along the guides 22*a* and 22*b*, performed by the actuation of the motor 27, causes the translatory motion of the rod 8 along its axis to achieve its insertion between the underlying rollers 3*a* and 3*b* or its extraction therefrom.

Figure 6:
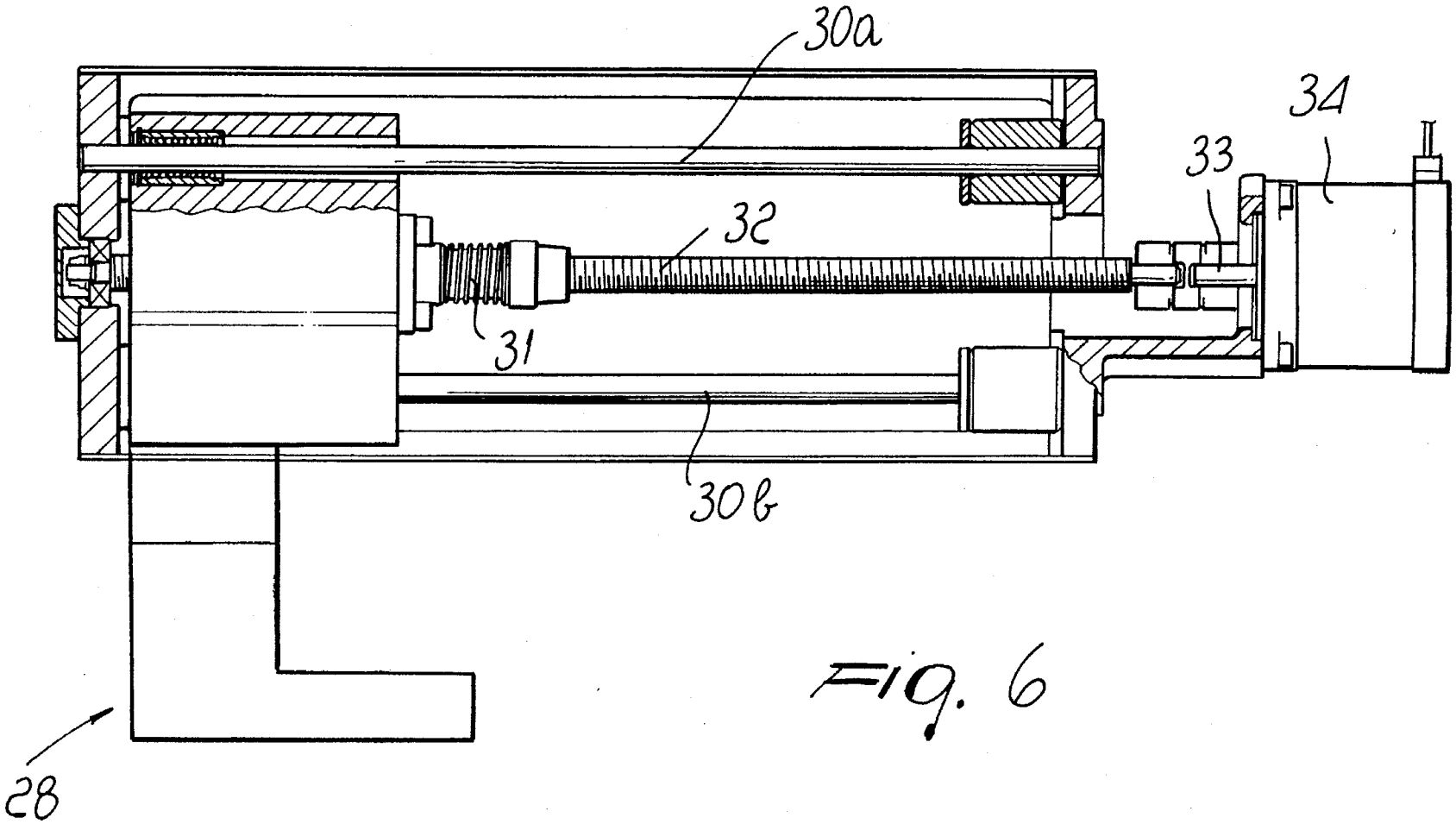
FIG. 6 is a schematic view of the means for positioning the stocking to be turned the right way out, shown in a cross-section taken along the plane VI—VI referenced in FIG. 1.

The means 9 for positioning the stocking 60 between the rollers 3*a* and 3*b*, as shown in particular in FIG. 6, comprise a gripper 28 supported by a slider 29 that is slidable along two guides 30*a* and 30*b* rigidly coupled to the supporting structure 2. The guides 30*a* and 30*b* are arranged horizontally on the front side of the machine and are parallel to the axes of the rollers 3*a* and 3*b*.

The slider 29 is rigidly coupled to an internal thread 31, with which a screw 32 engages; said screw 32 is arranged parallel to the guides 30*a* and 30*b* and is supported by the supporting structure 2 so that it can rotate about its own axis. The screw 32 is connected to the output shaft 33 of a variable-speed motor 34. The motor 34 is constituted by an electric motor, preferably a step motor.

The gripper 28 is constituted by two wings 35*a* and 35*b*, at least one of which can move towards or away from the other, so as to grip or release the stocking 60. The opening and closing movement of the gripper 28 can be achieved by means of an electromagnet 36 or another technically equivalent actuator.

Figure 7:
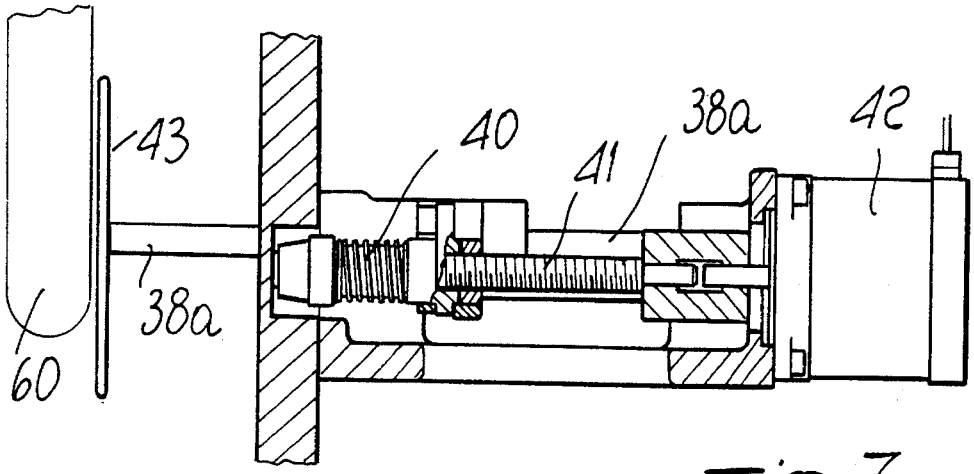
FIG. 7 is a sectional view of a detail of the machine, taken along the plane VII—VII of FIG. 1.
Figure 8:
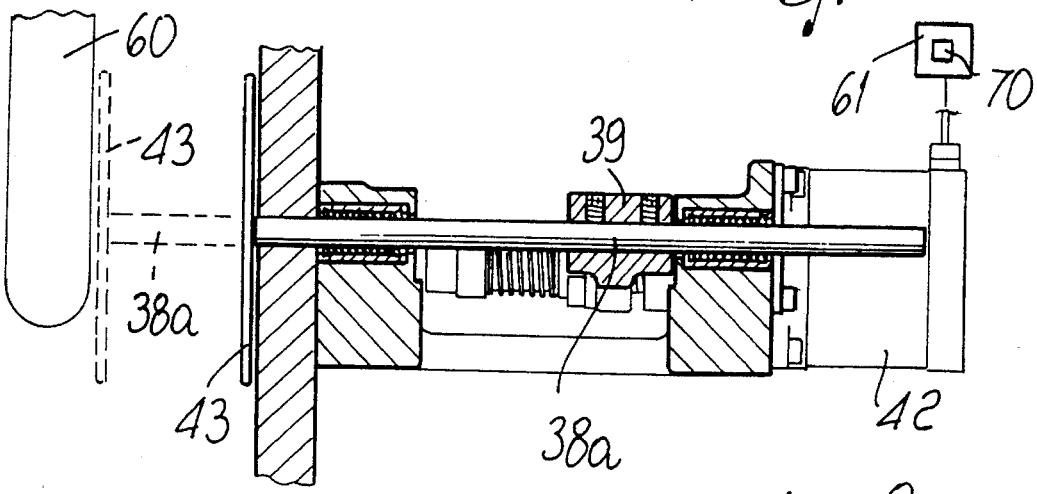
FIG. 8 is a view of the same detail of FIG. 7 in a different operating position.
Figure 9:
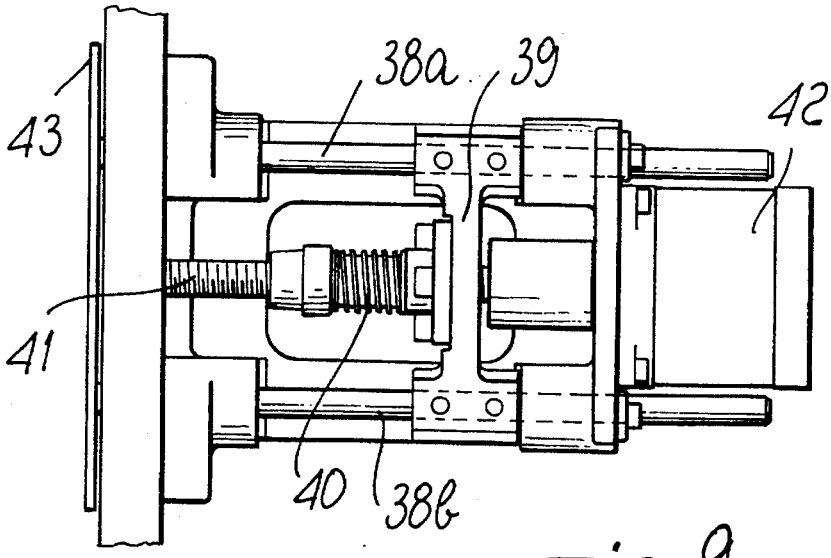
FIG. 9 is a top plan view of the same detail of FIGS. 7 and 8.

The machine according to the invention also comprises, below the first pair of rollers 3*a* and 3*b*, means for centering the stocking 60 during its positioning between the rollers 3*a* and 3*b* and during the subsequent stage for turning the stocking the right way out. Said means for centering the stocking 60 comprise a plate 43 arranged on a vertical plane, at right angles to the median plane 5, and fixed, as shown in particular in FIGS. 7 to 9, to two guides 38*a* and 38*b* that are arranged horizontally and parallel to the axes 4*a* and 4*b* of the rollers 3*a* and 3*b*.

The guides 38*a* and 38*b* are supported by the supporting structure 2 so that they can slide along their axis and they are mutually rigidly connected by a cross-member 39 that is rigidly coupled to an internal thread 40 with which a screw 41 engages; said screw is orientated parallel to the guides 38*a* and 38*b* and is supported, for rotation about its own axis, by said supporting structure 2. The screw 41 is connected to the output shaft of a motor 42 that is preferably constituted by a variable-speed electric motor whose actuation causes, by virtue of the connection between the screw 41 and the internal thread 40, the translatory motion of the guides 38*a* and 38*b* and therefore of the plate 43 along a direction that is parallel to the axes 4*a* and 4*b* of the rollers 3*a* and 3*b*. In practice, the plate 43 delimits the movement of the stocking 60 in the median plane 5 toward the machine.

Below the rollers 3*a* and 3*b* there are also means for limiting the lateral movement of the stocking 60 while turning it the right way out; said means include two lateral bars 44*a* and 44*b* arranged laterally on opposite sides with respect to the median plane 5 and controllably move towards or away from each other so as to limit the movement of the stocking 60 laterally on opposite sides with respect to the median plane 5.

Figure 11:
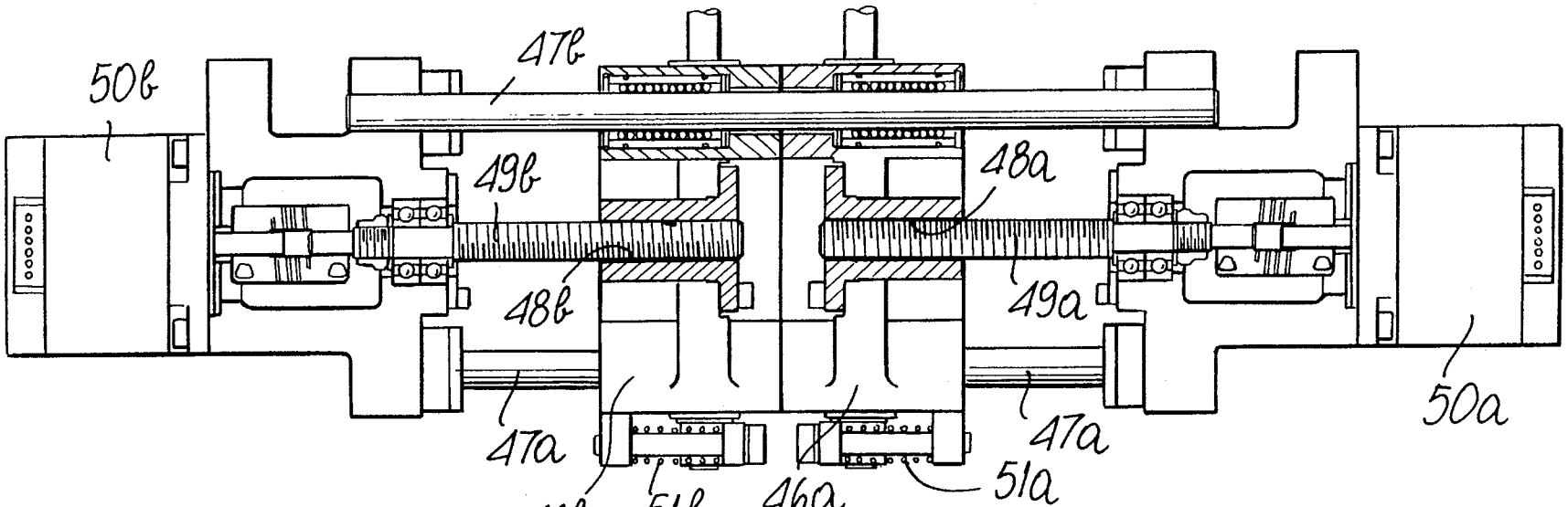
FIG. 11 is a schematic sectional view of FIG. 10, taken along the plane XI—XI.
Figure 10:
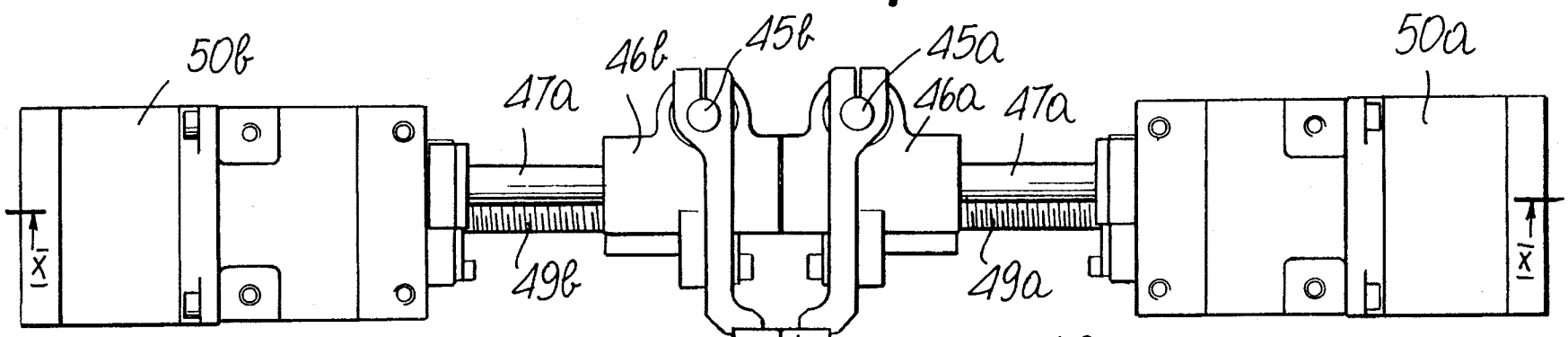
FIG. 10 is an enlarged-scale view of a detail of FIG. 1, with the supporting structure omitted for the sake of simplicity.

More particularly, as shown in particular in FIGS. 10 and 11, the bars 44*a* and 44*b* are supported, so that they can oscillate about respective axes 45*a* and 45*b* that are parallel to the axes 4*a* and 4*b*, by blocks 46*a* and 46*b* that are supported so that they can slide along guides 47*a* and 47*b* that are rigidly coupled to the supporting structure and are arranged horizontally and transversely to the axes 4*a* and 4*b*. The blocks 46*a* and 46*b* are internally provided with internal threads 48*a* and 48*b*, with which respective screws 49*a* and 49*b* engage: said screws are parallel to the guides 47*a* and 47*b* and are connected respectively to the output shaft of a motor 50*a* and of a motor 50*b* that are supported by the supporting structure 2. The motors 50 are preferably constituted by variable-speed electric step motors. The actuation of the motors 50*a* and 50*b* causes the mutual approach of the blocks 46*a* and 46*b* and therefore the mutual approach or spacing of the bars 44*a* and 44*b*.

The oscillation of the bars 44*a* and 44*b* about their respective axes 45*a* and 45*b* is elastically contrasted or biased by springs 51*a* and 51*b* that can be pre-loaded so as to ensure the required pressure on the stocking 60. In practice, the springs 51*a* and 51*b* act as damping elements for the resting of the bars 44*a* and 44*b* on the two opposites sides of the stocking.

Below the rollers 3*a* and 3*b* there are also means for guiding the stocking 60 while it is being turned the right way out. Said stocking guiding means also comprise a fork-like element, generally designated by the reference numeral 52, which has two arms 53*a* and 53*b* that are substantially parallel to each other and horizontal and can oscillate, rigidly with respect to each other, about a vertical axis 54 so as to move the two arms 53*a* and 53*b* from an inactive position, in which they are laterally spaced from the front side of the machine, to an active position, in which said arms 53*a* and 53*b* face the plate 43 to delimit the movement of the stocking 60 in a direction that is parallel to the axes 4*a* and 4*b* away from the plate 43. The oscillation of the fork-like element 52 about the axis 54 is performed by a motor 59 that is preferably constituted by an electric step motor, which is supported by the supporting structure 2 and is connected to the two arms 53*a* and 53*b* by means of its output shaft, which is arranged on the axis 54.

Below the rollers 3*a* and 3*b*, at a distance that can be adjusted according to the requirements, there is an element for detecting the presence of the stocking 60, which is constituted for example by a photocell 55.

Below the rollers 3*a* and 3*b* there is also a deflector element 56 that is constituted by a flap that can oscillate about an axis 57 which is parallel to the axes 4*a* and 4*b* of the rollers 3*a* and 3*b* so as to pass from an inactive position, in which it is arranged substantially vertically and laterally to the median plane 5 to avoid hindering the positioning of the stocking between the rollers 3*a* and 3*b* during feeding, to an active position, in which it intersects said median plane 5, so as to laterally divert the descent of the stocking 60 that has been turned the right way out correctly. The oscillation of the deflector element 56 is achieved by fixing one end of the deflector element 56 to the output shaft of an electric motor 58 that is preferably constituted by a step motor. As an alternative, the motor 58 can be replaced with an electromagnet.

The various elements that actuate the moving parts of the machine, i.e., the motors 12*a* and 12*b* that turn the rollers 3*a* and 3*b* about their respective axes, the motors that turn the rollers 6*a* and 6*b* about their respective axes, the motor 27 that actuates the axial translatory motion of the rod 8, the motors 15*a* and 15*b* that cause the mutual approach of the rollers 3*a* and 3*b*, the motors that cause the mutual approach or spacing of the rollers 6*a* and 6*b*, the motor 42 that actuates the plate 43, the motors 50*a* and 50*b* that actuate the bars 44*a* and 44*b*, the motor 34 that moves the gripper 28 along the guides 30*a* and 30*b*, as well as the electromagnet 36 that opens or closes said gripper 28, the motor 59 that actuates the fork-like element 52, and the motor 58 that actuates the deflector element 56, are connected to a programmable actuation and control unit 61 that comprises a microprocessor that supervises the operation of the entire machine. The actuation and control unit 61 comprises memory means 70 that are adapted to store the various operating parameters of the machine. Said memory means can be advantageously included in a PC (personal computer), so that said PC also acts as an interface between the user and the machine. The actuation and control unit 61 is also connected, by means of its input, to the photocell 55 and to an auxiliary photocell 63 that is arranged at the end of the line 65 for sewing or linking the stocking 60.

The memory means 70 of the actuation and control unit 61 are programmed by presetting the actuation speed of the various variable-speed motors and so that the actuation of said motors occurs, if required, with acceleration and deceleration ramps during startup and stopping. In particular, the actuation speed of the motors that actuate the rollers 3*a* and 3*b* and of the motors that actuate the rollers 6*a* and 6*b* is programmed in the memory means 70 with acceleration and deceleration ramps. Furthermore, if brushless electric motors are used to turn at least the rollers 3*a* and 3*b* about their respective axes, this actuation is programmed so that said rollers are preferably actuated with a constant torque.

The memory means 70 of the actuation and control unit 61 are also programmed so that said unit determines the actuation of the motors that cause the translatory motion of the rollers towards or away from each other to move them to a preset maximum approach distance. In the same manner, the translatory motion of the rod 8 along its axis, achieved by means of the actuation of the motor 27, as well as the translatory motion of the plate 43, is programmed in the actuation and control unit 61.

A plurality of actuation programs are also provided in the memory means 70 of the actuation and control unit 61 and have parameters for the actuation of the various motors which are correlated to different types of stockings to be turned the right way out; said programs can be selected by the user, for example by means of a keyboard.

The actuation and control unit 61 also controls the space covered by the rollers by means of magnetic sensors of the Hall-effect type inserted in the bodies of the motors.

The operation of the machine according to the invention is as follows. The operator, according to the type of stocking that must be turned the right way out, selects the corresponding program that is set in the actuation and control unit 61. When the machine is in the inactive condition, the rollers 3*a* and 3*b* and the rollers 6*a* and 6*b* are mutually spaced and the rod 8 is arranged between the upper rollers 6*a* and 6*b*. The fork-like element 52 is in the inactive position, whereas the bars 44*a* and 44*b* are mutually spaced.

Depending on the selected program, i.e., on the type of stocking 60 to be turned the right way out, the actuation and control unit 61 causes a controlled translatory motion of the plate 43 away from the front side of the machine, parallel to the direction of the translatory motion of the gripper 28.

Figure 12:
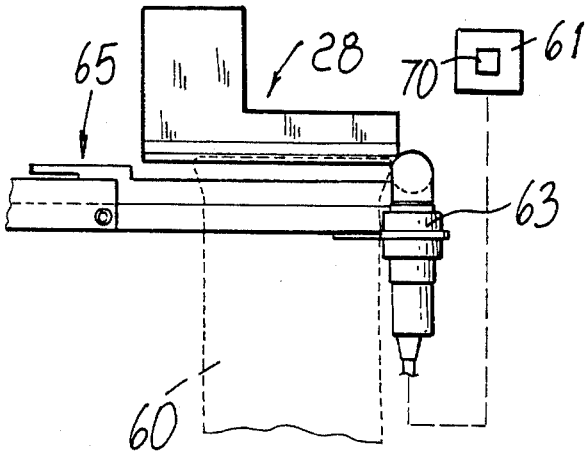
FIGS. 12 to 20 are schematic views of the operation of the machine according to the invention, with details of the machine shown in a lateral elevation view in FIG. 12 and in a plan view in FIG. 14, the machine being instead shown schematically in a front view in the remaining figures.
Figure 13:
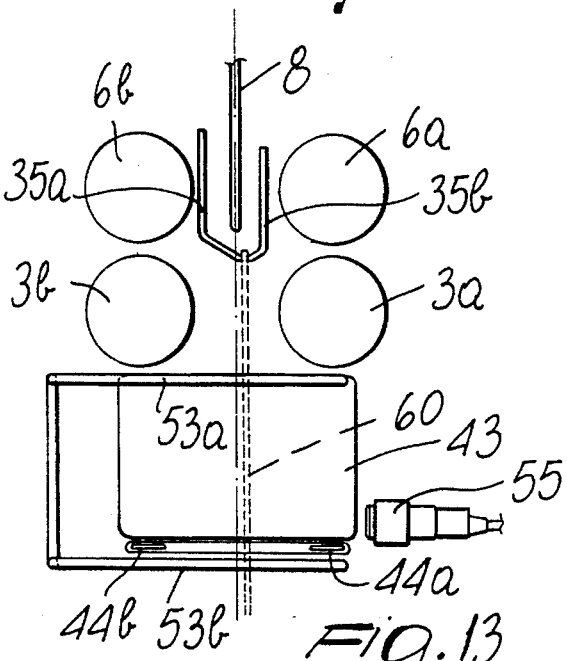

The actual operating cycle of the machine begins as soon as the photocell 63 detects the presence of a stocking 60 to be turned the right way out at the end of the sewing or linking line 65. As a consequence of detecting and signalling the presence of the stocking 60, the actuation and control unit 61 actuates the gripper 28 so that it grips the tip or toe portion of the stocking 60 and moves it between the lower rollers 3*a* and 3*b* (FIGS. 12 and 13). The speed of the translatory motion of the gripper 28 can be applied with an adequately reduced acceleration to avoid excessive swinging of the stocking.

Figure 15:
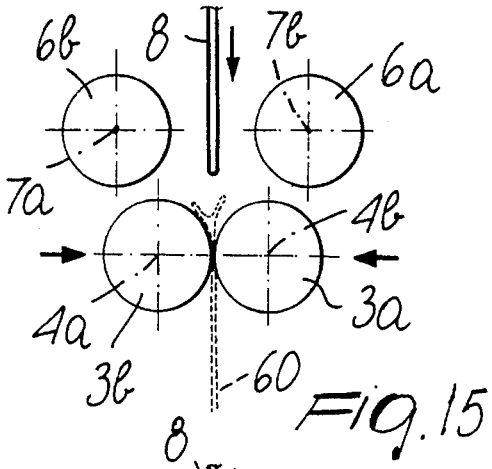
Figure 16:
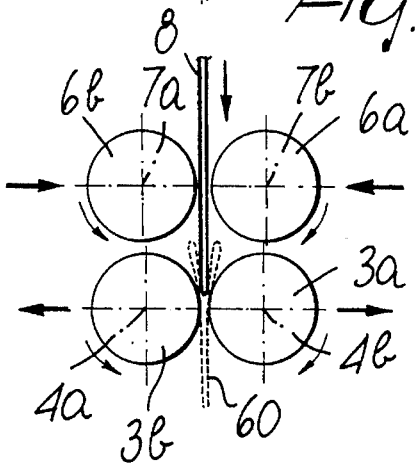
Figure 14:
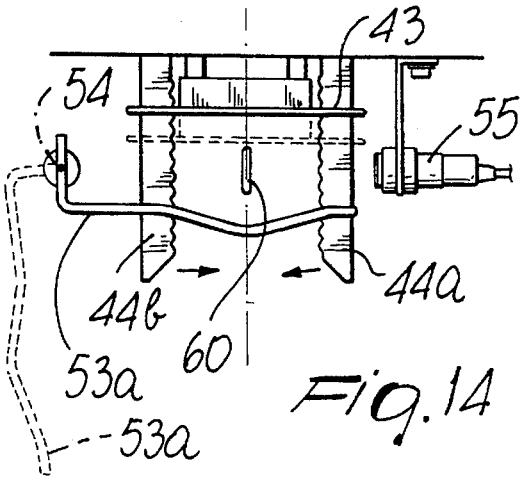

At this point, the actuation and control unit 61 activates the motors 15*a* and 15*b*, which cause the mutual approach of the lower rollers 3*a* and 3*b* that retain the stocking 60, with a translatory motion that has a preset extent, while the gripper 28 is disengaged from the tip of the stocking and moved away from the rollers. At the same time, the bars 44*a* and 44*b* are moved mutually closer and the fork-like element 52 is moved into the active position, so as to keep the stocking correctly positioned (FIGS. 14 and 15). Then the rod 8 is lowered until it reaches, with its lower end, the plane of arrangement of the axes of the rollers 3*a* and 3*b*, engaging the tip or toe of the stocking, and the upper rollers 6*a* and 6*b* are moved mutually closer by virtue of a translatory motion, the extent of which is controlled. At this point, both the lower rollers 3a and 3b and the upper rollers 6a and 6b are turned about their respective axes, whereas the rod 8 is raised above the region of tangency of the rollers 3a and 3b (FIG. 16).

Figure 17:
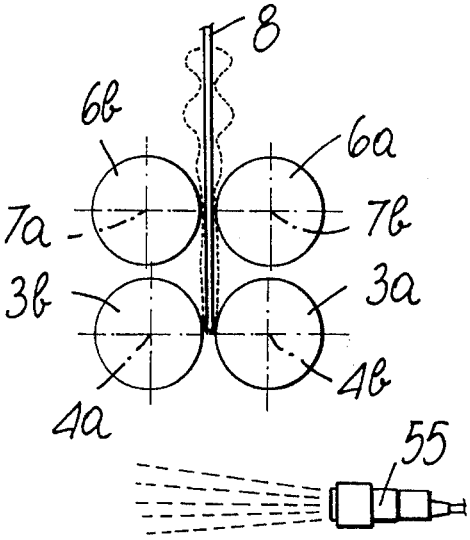

The direction of the rotation of the rollers 3a and 3b and of the rollers 6a and 6b is such that the peripheral speed of the rollers in the regions in contact with the stocking 60 is directed upwards, so that the combined action of the rod 8 and of the rollers 3a and 3b turns the stocking the right way out along the rod 8, pushing it upwards until it is gripped by the upper rollers 6a and 6b that complete the action of turning it the right way out (FIG. 17).

It should be noted that the rod 8 can remain motionless for all the time required to turn the stocking 60 the right way out on the rod 8.

A particularly advantageous aspect of the machine according to the invention is constituted by the fact that the motors that turn the rollers 3a and 3b about the respective axes and, optionally, the motors that turn the rollers 6a and 6b about their respective axes, are actuated at a variable speed by the actuation and control unit 61 with an acceleration curve or ramp which gradually increases their rotation rate, and which can be changed according to the type of stocking. The possibility of slippage of the rollers on the stocking is minimized, thus protecting the integrity of said stocking.

Furthermore, if the rollers 3a and 3b, and optionally the rollers 6a and 6b, are rotated about their respective axes by using brushless-type motors, it is also possible to keep the actuation torque of said rollers constant, with the advantage that if wrinkles or other obstacles that hinder the rotation of the rollers occur while the stocking is being turned the right way out, said rollers slow down automatically, thus avoiding damage to the stocking, and return to the programmed speed as soon as said hindrance ceases.

Figure 18:
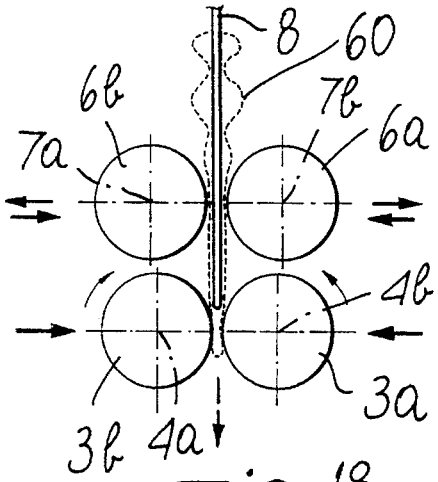
Figure 19:
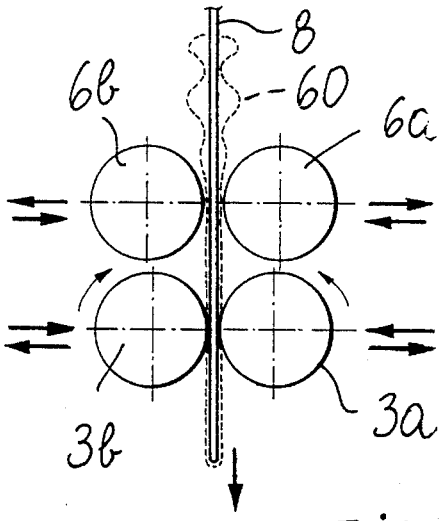
Figure 20:
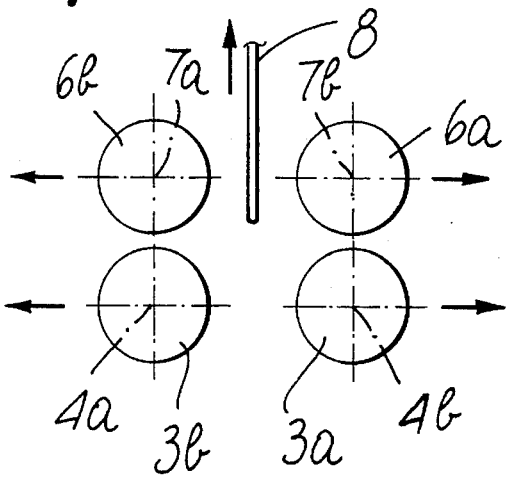

When the stocking has been turned the right way out completely along the rod 8, the photocell 55 senses that the stocking is missing below the rollers 3a and 3b and signals this condition to the actuation and control unit 61. As a consequence of this signal, the actuation and control unit 61 activates the spacing of the fork-like element 52, the retraction of the plate 43, and the mutual spacing of the bars 44a and 44b. The actuation and control unit 61 then stops the upper rollers 6a and 6b and actuates the descent of the rod 8. The actuation and control unit 61 slightly spaces the lower rollers 3a and 3b from each other to avoid damaging the stocking 60 while the direction of the rotation of said rollers is reversed (FIG. 18). The rollers 3a and 3b, after reversing their motion, are moved towards each other again, so as to increase the pressure on the stocking 60 in order to be able to remove it from the rod 8 even in the case of very elastic stockings. Meanwhile, the rod 8 continues to move downwards, preferably with a speed that is substantially equal to the peripheral speed of the rollers 3a and 3b, until it reaches a position that is preset in the actuation and control unit 61 (FIG. 19). The rotation of the rollers 3a and 3b thus performs the complete removal of the stocking 60 from the rod 8, whereas the upper rollers 6a and 6b can be actuated by the actuation and control unit 61 so as to move closer and further apart, in a cyclic pattern, so as to spread the stocking out flat during removal. The stocking that has been turned the right way out then drops below the rollers 3a and 3b and is diverted laterally by the deflector element 56, which has been moved into the active position, in a region where it is possible to provide, in a known manner, the inlet of a duct for removing the stocking or a collecting container, while the various elements of the machine are returned to the starting positions to perform a new cycle (FIG. 20).

If operating anomalies occur while turning the stocking the right way out, the actuation and control unit 61 does not actuate the motor 58 or the electromagnet, so as to keep the deflector element 56 in the inactive position, consequently causing the stocking that has been subjected to an abnormal cycle to fall into a region that is different from the region where stockings, that have been correctly turned the right way out, fall.

It should be noted that while the stocking is being turned the right way out on the rod 8, the motors 12a and 12b can be actuated with an equal rotation rate or with different rotation rates, so as to take into account the presence, on one side of the stocking, of the heel region, which entails a greater length to be turned the right way out.

Likewise, the rotation rate of the rollers 6a and 6b can also be diversified according to the requirements.

In practice, it has been observed that the machine according to the invention fully achieves the intended aim, since by virtue of the fact that it can be actuated according to preset programs and with operating parameters that can vary according to the requirements, it is capable of turning the right way out a wide range of hosiery item types with high operating reliability and without requiring any manual intervention for adjustment on the part of the operator.

Another advantage of the machine according to the invention is constituted by the possibility of repeating, with high precision, the operating cycles that have been preset by programming the actuation and control unit.

Another advantage is that it is possible to manage the various actuators that actuate the moving parts of the machine both independently and in a correlated manner, to adapt the operation of the machine to specific requirements, thus obtaining turning cycles that are always fully satisfactory when the type of stocking to be turned the right way out changes.

Furthermore, the use of motors of the brushless type is particularly advantageous, in view of the intense use of the actuation means of the rollers during the stage for turning the stocking the right way out. Any use of DC motors would be short-lived, since the machine is subjected to constant direction reversals, with consequent wear of the carbon contacts.

The machine thus conceived is susceptible of numerous modifications and variations, all of which are within the scope of the inventive concept; all the details may furthermore be replaced with other technically equivalent elements.

In practice, the materials employed, as well as the dimensions, may be any according to the requirements and the state of the art.

What is claimed is:

1. A machine for turning stockings the right way out, with high operating reliability, comprising: protruding from slots at least one first pair of rollers that have mutually parallel axes, are arranged laterally on opposite sides with respect to an imaginary median plane that is parallel to the axes of said rollers, and can be rotated about their respective axes in mutually opposite rotational directions; means for positioning a stocking to be turned the right way out between said first pair of rollers; first motor means for moving said rollers mutually closer or further apart along a straight line in sliding movement on carriages to retain, between said rollers, the stocking carried by said positioning means; first actuation means for rotating said rollers about their respective axes in mutually opposite rotational directions; a rod controllably insertable between said rollers and cooperating with said rollers to turn the stocking the right way out along said rod; means for moving said rod along its own axis, which is arranged in said median plane and is substantially perpendicular to the axes of said rollers, for the insertion of said rod between said rollers or the extraction of said rod therefrom; wherein said first means for rotating said rollers about their respective axes comprise at least one first variable-speed motor.

2. Machine according to claim 1, wherein it comprises a programmable actuation and control unit operatively connected to said at least one first variable-speed motor for its actuation with a variable speed according to parameters stored in memory means of said actuation and control unit.

3. Machine according to claim 2, wherein it comprises: a second pair of rollers having parallel axes and being rotatable about their respective axes with mutually opposite rotational directions, the rollers of said second pair of rollers having axes parallel to the axes of the rollers of the first pair of rollers, and being arranged laterally on opposite sides with respect to said median plane, and spaced from said first pair of rollers toward said rod; said machine further comprising second means for the mutual approach or spacing of said rollers of the second pair of rollers; and second actuation means for rotating the rollers of said second pair of rollers about their respective axes and with mutually opposite directions of rotation, said means comprising at least one variable-speed motor.

4. Machine according to claims 3, wherein said programmable actuation and control unit is operatively connected to said at least one variable-speed motor of the second actuation means for its actuation with a variable speed according to a preset program.

5. Machine according to claim 4, wherein it comprises a variable-speed motor for each one of said rollers.

6. Machine according to claim 5, wherein the variable-speed motors that actuate the rollers of said first pair of rollers can be actuated by said actuation and control unit independently of each other.

7. Machine according to claim 5, wherein the variable-speed motors that actuate said rollers can be actuated by said actuation and control unit independently of each other.

8. Machine according to claim 3, wherein said variable-speed motors are constituted by electric motors.

9. Machine according to claim 3, wherein said actuation and control unit is adapted to actuate said variable-speed motors with a constant torque.

10. Machine according to claim 1, wherein said rollers are mounted on a supporting structure so that their axes lie substantially horizontally, said rod being mounted on said supporting structure so that its axis is arranged substantially vertically and tangent to the rollers of the first pair of rollers and of the second pair of rollers in the mutual approach position, said rod being controllably movable along its own axis starting from an inactive position, whereat said rod is spaced in an upward region from said first pair of rollers, to an active position, whereat said rod is inserted between said first pair of rollers, said second pair of rollers being arranged above said first pair of rollers.

11. Machine according to claim 1, wherein said first means for the mutual approach or spacing of the rollers of said first pair of rollers comprise two carriages, each of which supports one of said rollers of the first pair of rollers with a corresponding actuation motor; said carriages being supported by said supporting structure such that they can slide along a sliding direction that is substantially perpendicular to said median plane, first controllably actuated translation motion means being provided for the translatory motion of said carriages away from each other along said sliding direction.

12. Machine according to claim 11, wherein said first translatory motion means comprise at least one variable-speed motor.

13. Machine according claim 3, wherein said second means for the mutual approach or spacing of the rollers of said second pair of rollers comprise two carriages, each of which supports one of said rollers of the second pair of rollers with a corresponding actuation motor; said carriages being supported by a supporting structure for sliding along a sliding direction that is substantially perpendicular to said median plane, second controllably actuated translation motion means being provided for the translatory motion of said carriages away from each other along said sliding direction.

14. Machine according to claim 13, wherein said second translatory motion means comprise at least one variable-speed motor.

15. Machine according to claim 12, wherein said at least one variable-speed motor of the translatory motion means is constituted by a variable-speed electric motor.

16. Machine according to claim 15, wherein said variable-speed electric motor is constituted by a step motor.

17. Machine according to claim 15, wherein said electric motor is constituted by a brushless motor.

18. Machine according to claim 2, wherein said first actuation means are operatively connected to said actuation and control unit for a controlled translatory motion of said rollers of the first pair of rollers towards or away from each other.

19. Machine according to claim 3, wherein said second actuation means are operatively connected to said actuation and control unit for a controlled translatory motion of the rollers of said second pair of rollers toward or away from each other.

20. Machine according to claim 1, wherein said rod is mounted on a slider that is supported by a supporting structure so that it can slide along a direction that is substantially parallel to the axis of said rod, said means for the movement of said rod along its own axis comprising a variable-speed motor.

21. Machine according to claim 20, wherein said variable-speed motor of the means for the movement of said rod is constituted by an electric motor.

22. Machine according to claim 20, wherein said means for moving said rod along its own axis are operatively connected to a actuation and control unit for a controlled translatory motion of said rod along its own axis.

23. Machine according to claim 21, wherein said electric motor of the means for moving said rod is constituted by a step motor.

24. Machine according to claim 21, wherein said electric motor of the means for moving said rod is constituted by a brushless motor.

25. Machine according to claim 1, wherein said means for positioning the stocking to be turned the right way out between said first pair of rollers comprise a gripper mounted on a slider supported by a supporting structure so that it can slide along a feeding direction that is substantially parallel to the axes of said rollers, means being provided for the translatory motion, along said feeding direction, of said slider that supports said gripper.

26. Machine according to claim 25, wherein said gripper is arranged so that its grip jaws are at said median plane, means being provided for opening and closing the jaws of said gripper.

27. Machine according to claim 26, wherein said means for opening and closing the jaws of said gripper are constituted by an actuator that is operatively connected to a actuation and control unit.

28. Machine according to claim 25, wherein said means for the translatory motion, along said feeding direction, of said slider that supports said gripper comprise a variable-speed electric motor that is operatively connected to a programmable actuation and control unit.

29. Machine according to claim 1, wherein it comprises, below said first pair of rollers, means for centering a stocking during its positioning between the rollers of said first pair of rollers and during its subsequent turning the right way out.

30. Machine according to claim 29, wherein said means for centering the stocking comprise a plate arranged substantially at right angles to said median plane and supported by a supporting structure for sliding along a direction substantially parallel to a feeding direction, means being provided for the controlled translatory motion of said plate, parallel to said feeding direction, to limit the advancement of the stocking toward the side of the machine that supports said rollers.

31. Machine according to claim 1, wherein it comprises, below said rollers of the first pair of rollers, means for guiding the stocking while it is being turned the right way out.

32. Machine according to claim 31, wherein said means for guiding comprise a fork-like element that can face, on command, a plate to limit the movement of the stocking along a feeding direction away from said plate.

33. Machine according to claim 1, wherein it comprises, below said rollers of the first pair of rollers, means for limiting the lateral movement of the stocking while it is being turned the right way out.

34. Machine according to claim 33, wherein said means for limiting the lateral movement of the stocking comprise two lateral bars arranged laterally on opposite sides with respect to said median plane and substantially parallel to said median plane, said bars being movable on command towards or away from each other to laterally engage the stocking on opposite sides.

35. Machine according to claim 34, wherein it comprises means for cushioning the pressure applied by said lateral bars to the stocking.

36. Machine according to claim 34, wherein a actuation and control unit is operatively connected to a centering means, to a guiding means, and to said means for limiting the lateral movement of the stocking in order to actuate them according to a preset sequence.

37. Machine according to claim 2, wherein it comprises, below said rollers, means for sensing the presence of the stocking, said sensing means being operatively connected in input to said actuation and control unit.

38. Machine according to claim 3, wherein stored parameters define parameters for acceleration and deceleration during the startup and stopping of said motors.

39. Machine according to claim 38, wherein said stored parameters are the translatory motion of said rod along its own axis.

40. Machine according to claim 38, wherein said stored parameters are the translatory motion performed by the first means for the mutual approach or spacing of said rollers that cause the mutual approach or spacing or rollers in order to move them to a preset maximum approach distance.

41. Machine according to claim 3, wherein said memory means comprise a plurality of actuation programs with parameters for the actuation of said motors that are correlated to different types of stockings to be turned the right way out.

* * * * *